US011617491B2

(12) United States Patent
Park et al.

(10) Patent No.: US 11,617,491 B2
(45) Date of Patent: Apr. 4, 2023

(54) DISHWASHER

(71) Applicant: SAMSUNG ELECTRONICS CO., LTD., Suwon-si (KR)

(72) Inventors: Kitae Park, Suwon-si (KR); Youngjae Kim, Suwon-si (KR); Youngsu Ser, Suwon-si (KR); Changwook Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 159 days.

(21) Appl. No.: 16/913,516

(22) Filed: Jun. 26, 2020

(65) Prior Publication Data

US 2020/0405121 A1 Dec. 31, 2020

(30) Foreign Application Priority Data

Jun. 27, 2019 (KR) ..... 10-2019-0077315

(51) Int. Cl.
*A47L 15/42* (2006.01)
*A47L 15/22* (2006.01)

(52) U.S. Cl.
CPC ..... *A47L 15/421* (2013.01); *A47L 15/22* (2013.01); *A47L 15/4257* (2013.01); *A47L 15/4293* (2013.01)

(58) Field of Classification Search
CPC .... A47L 15/22; A47L 15/4257; A47L 15/421; A47L 15/4293
See application file for complete search history.

(56) References Cited

U.S. PATENT DOCUMENTS

| | | | | |
|---|---|---|---|---|
| 5,836,324 | A | 11/1998 | Johnson et al. | |
| 6,006,767 | A * | 12/1999 | Hecker | A47L 15/4263 134/201 |
| 7,556,049 | B2 * | 7/2009 | Oakes | A47L 15/488 34/235 |
| 8,313,583 | B2 * | 11/2012 | May | A47L 15/488 134/57 D |
| 2008/0134728 | A1 | 6/2008 | Son | |
| 2010/0156259 | A1 | 6/2010 | May et al. | |

FOREIGN PATENT DOCUMENTS

| | | |
|---|---|---|
| CN | 105996947 A | 10/2016 |
| EP | 2741015 | 2/2018 |
| JP | 5-51282 | 7/1993 |
| JP | 2015-119744 | 7/2015 |
| KR | 20-1993-0011106 | 6/1993 |
| KR | 10-1138884 | 5/2012 |

OTHER PUBLICATIONS

European Search Report dated May 2, 2022 issued in European Application No. 20832809.
International Search Report dated Oct. 28, 2020 in International Patent Application No. PCT/KR2020/008148.

* cited by examiner

*Primary Examiner* — Benjamin L Osterhout
(74) *Attorney, Agent, or Firm* — Staas & Halsey LLP

(57) ABSTRACT

A dishwasher with an improved door structure. The dishwasher includes a cabinet having a washing tub and a door installed at one side of the cabinet to open and close the washing tub, wherein the door includes a door member in which an electrical component is installed, a handle member installed on the door member to form a handle, and a water discharge channel allowing water to be discharged to outside of the door through the door member and the handle member.

17 Claims, 8 Drawing Sheets

DISHWASHER

CROSS-REFERENCE TO RELATED APPLICATIONS

This application is based on and claims priority under 35 U.S.C. § 119 to Korean Patent Application No. 10-2019-0077315, filed on Jun. 27, 2019, in the Korean Intellectual Property Office, the disclosure of which is incorporated herein by reference.

BACKGROUND

1. Field

The disclosure relates to a dishwasher, and more specifically, to a dishwasher with an improved door structure.

2. Description of the Related Art

In general, a dishwasher refers to an apparatus that wash dishware by spraying high pressure water at the dishware and dry the dishware. Specifically, the dishwasher operates to spray high-pressure wash water in a washing tub storing dishware, allowing the sprayed wash water to reach the dishware, causing dirt, such as food debris on the surface of the dishware to be washed.

The dishwasher is provided with a main body accommodating a washing chamber, a washing tub provided inside the main body to form a washing space for dishware, a door located in front of the washing tub to open and close the washing tub, a locking device for maintaining a sealed state of the washing tub by the door, a sump unit provided at a lower side of the washing tub to supply, collect, circulate, and drain wash water for washing dishware, lower and upper arms configured to spray the wash water supplied by the sump unit to the dishware, and lower and upper baskets provided to be withdrawable from the inside the washing tub and configured to selectively load dishware according to the type and size of the dishware.

The user opens the door of the dishwasher and withdraws the basket in the washing tub to store dishware in the withdrawn basket, and pushes the withdrawn basket into the washing tub, and closes the door, thereby completing storing of the dishware. Subsequently, when the washing of the dishware is completed, contrary to the above, the user opens the door of the dishwasher, withdraws the basket in the washing tub, and removes the dishware from the withdrawn basket in the reverse mo.

In this case, when the dishware is removed, remaining water in the washing tub or wash water on the washed dishware may be caused to flow to the door.

The door of the dishwasher may be provided with a locking device, various control buttons, and a display displaying various pieces of information related to an operating status of the dishwasher, and the wash water flowing into the door may flow into various electrical components, causing defects.

SUMMARY

Therefore, it is an object of the disclosure to provide a dishwasher with an improved door structure.

It is another object of the disclosure to provide a dishwasher with an improved door structure in which water splashing into the door is discharged to the outside of the door.

It is another object of the disclosure to provide a dishwasher having an improved door structure in which water is discharged to prevent water from being infiltrated into electrical component installed in the door.

Additional aspects of the disclosure will be set forth in part in the description which follows and, in part, will be obvious from the description, or may be learned by practice of the disclosure.

In accordance with one aspect of the disclosure, there is provided a dishwasher including: a cabinet having a washing tub; and a door installed at one side of the cabinet to open or close the washing tub, wherein the door includes: a door member in which an electrical component is installed; a handle member installed on the door member to form a handle; and a water discharge channel formed thereof to allow water to be discharged to outside of the door through the door member and the handle member.

The water discharge channel may include a water inlet formed on at least one portion of the door; a first outlet formed on the door member; and a second outlet formed on the handle member and connected to the first outlet.

The door may include a rear cover configured to form a rear surface of the door, and the water inlet may be disposed on the rear cover.

The door member may include a control frame on which the electrical component and a printed circuit board (PCB) are installed and to which the handle member is coupled, wherein the first outlet is formed on the control frame.

The first outlet may be provided at a position corresponding to a position of the water inlet.

The first outlet may include a first discharge hole formed at a lower side of the control frame and a first discharge surface inclined to guide the water toward the first discharge hole.

The first outlet may further include a guide rib allowing water to be guided through the first discharge hole.

The control frame may further include at least one partition wall configured to limit movement of water of the first outlet.

The handle member may include: an inclined panel inclined in a direction toward an inside of the cabinet; and a handle cover coupled to the inclined panel and provided to form a handle recess between the door member and the handle cover, and wherein the second outlet is disposed on the handle cover.

The second outlet may include at least one second discharge hole.

The second discharge hole may be disposed at a position corresponding to a position of the first discharge hole.

The dishwasher may further include a water leakage preventing member provided to prevent water from leaking between the door member and the handle member.

The water leakage member may include a discharge port corresponding to the first discharge hole and the second discharge hole.

The second discharge hole may be disposed on the handle recess.

In accordance with another aspect of the disclosure, there is provided a dishwasher including: a cabinet having a washing tub; and a door rotatably installed at one side of the cabinet to open or close the washing tub, wherein the door may include a door member on which an electrical component and a printed circuit board (PCB) are installed; a handle member coupled to the door member and having a handle recess; and a water discharge channel formed thereof to allow water to be discharged through the door member and the handle recess of the handle member.

The water discharge channel may include: a water inlet formed on at least one portion of the door; a first outlet formed on the door member; and a second outlet formed on the handle member.

The first outlet may be provided at a position corresponding to a position of the water inlet.

The first outlet may include a first discharge hole formed at a lower side of the door member and a first discharge surface inclined to guide water toward the first discharge hole.

The second outlet may include at least one second discharge hole, and the second discharge hole may be disposed at a position corresponding to a position of the first discharge hole.

The dishwasher may further include a water leakage preventing member that includes a discharge port corresponding to the first discharge hole and the second discharge hole to prevent water from leaking between the first discharge hole and the second discharge hole.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
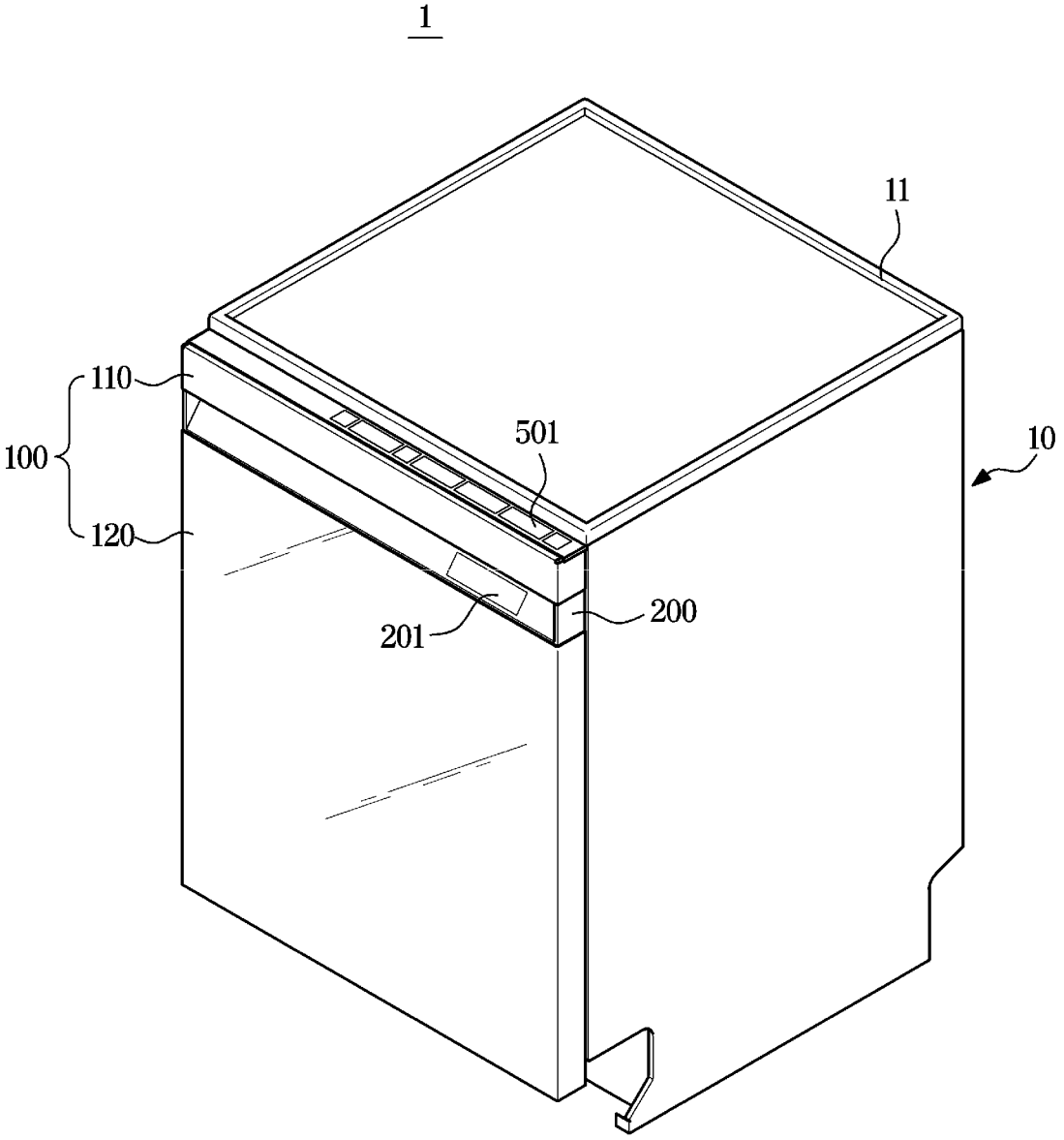
FIG. 1 is a perspective view illustrating a dishwasher according to an embodiment of the disclosure.

The embodiments set forth herein and illustrated in the configuration of the present disclosure are only the most preferred embodiments and are not representative of the full the technical spirit of the present disclosure, so it should be understood that they may be replaced with various equivalents and modifications at the time of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

Hereinafter, embodiments according to the disclosure will be described in detail with reference to the accompanying drawings.

Figure 2:
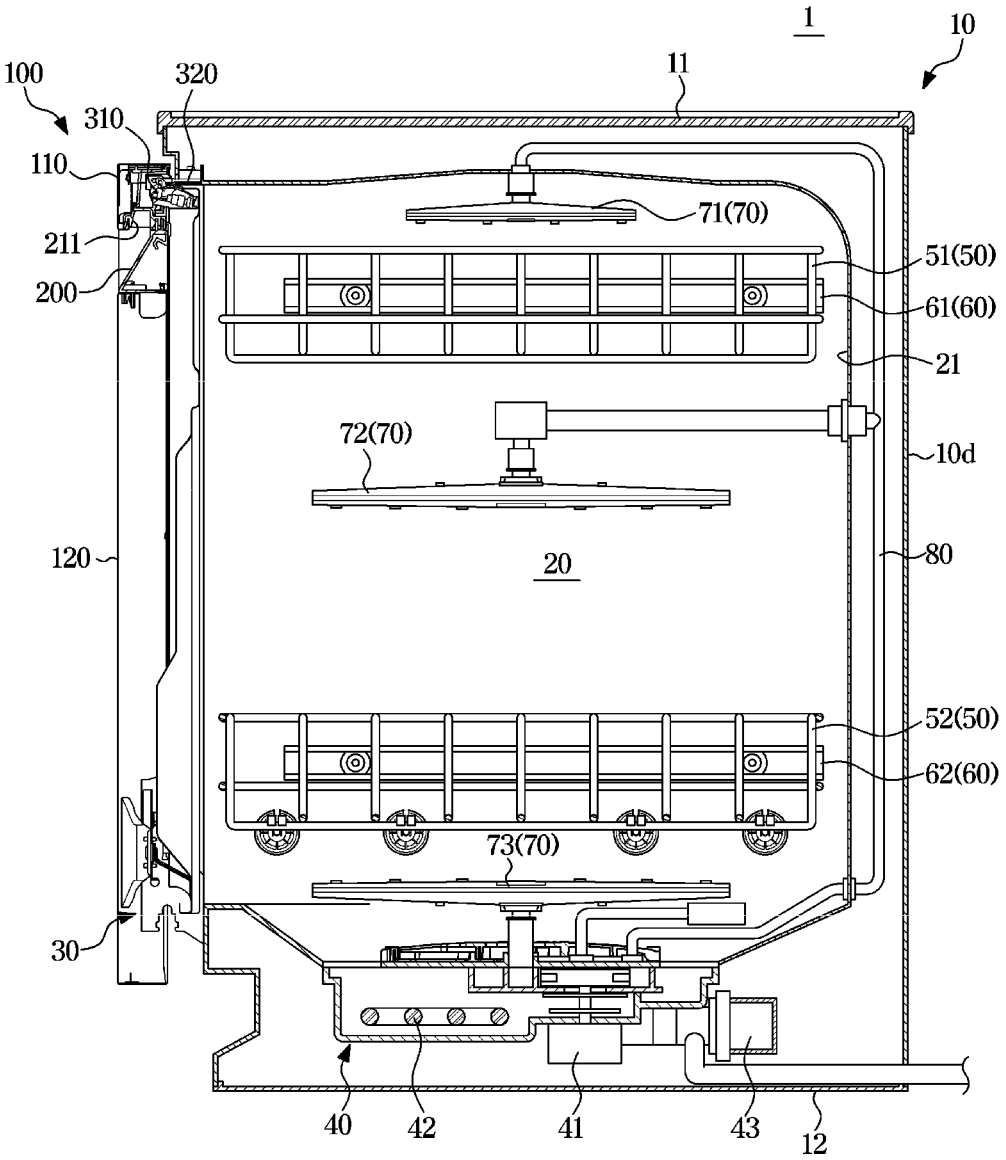
FIG. 2 is a cross-sectional view illustrating the dishwasher according to the embodiment of the disclosure.
Figure 3:
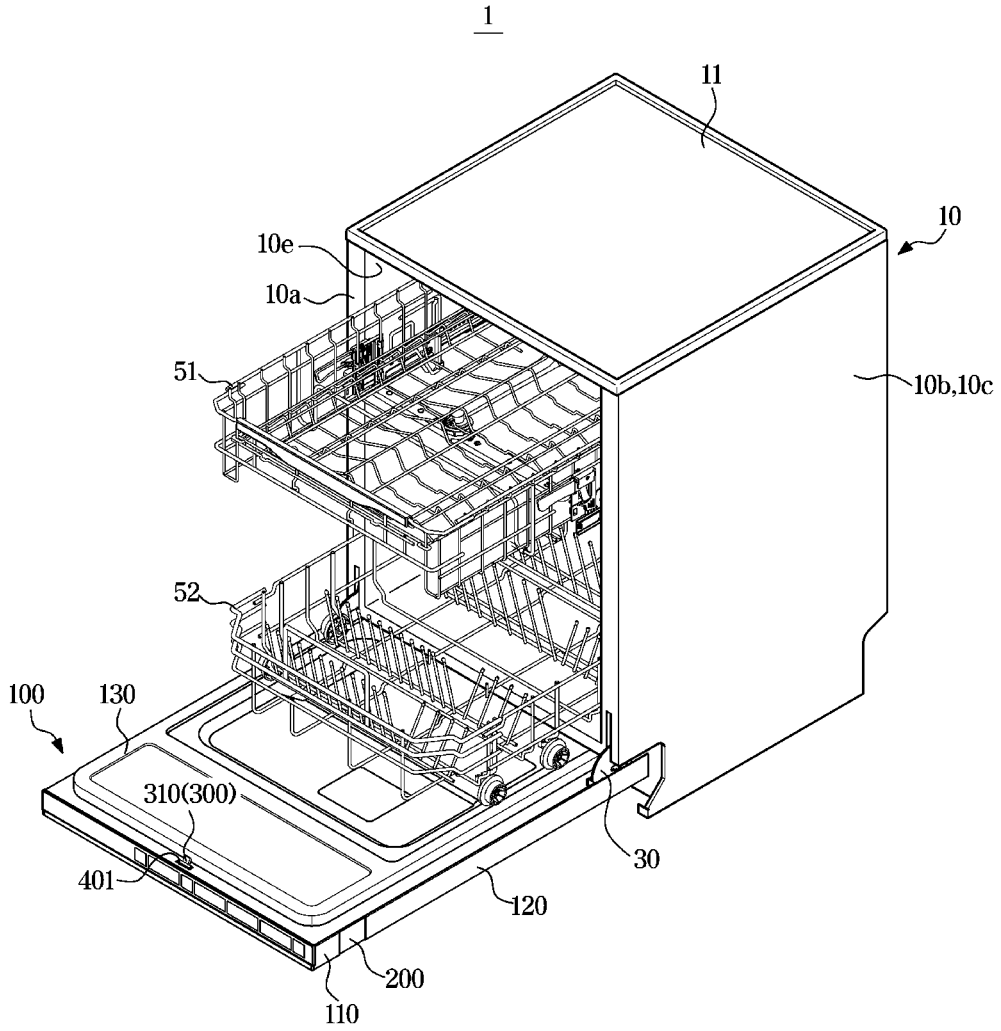
FIG. 3 is a perspective view illustrating the dishwasher with a door according to the embodiment of the disclosure.

FIG. 1 is a perspective view illustrating a dishwasher according to an embodiment of the disclosure, FIG. 2 is a cross-sectional view illustrating the dishwasher according to the embodiment of the disclosure, and FIG. 3 is a perspective view illustrating the dishwasher with a door according to the embodiment of the disclosure.

Referring to FIGS. 1 to 3, a dishwasher 1 includes a cabinet 10 forming the external appearance thereof, a washing tub 21 disposed inside the cabinet 10 and forming a washing chamber 20, and a door 100 installed on the cabinet 10 to open and close the washing tub 21.

The cabinet 10 and the washing tub 21 are each provided in the form of a hexahedron that has one side thereof openable. The cabinet 10 may be provided at a lower side thereof with a base 12 and at an upper side thereof with a top cover 11.

The cabinet 10 may include a rear plate 10*d*, side plates 10*b* and 10*c* extending from opposite sides of the rear plate 10*d* forward, and front plates 10*a* formed to be bent from the side plates 10*b* and 10*c*. The front plates 10*a* may be provided to form an opening 10*e* at the front of the cabinet 10. The door 100 may be provided to open and close the opening 10*e* of the front plate 10*a*. In the embodiment of the disclosure, the front plates 10*a* are illustrated as being formed to extend from the opposite side plates as an integral body, but the aspect of the disclosure is not limited thereto.

The door 100 may be rotatably installed on the cabinet 10. The door 100 may be rotatably hinged to a lower end of the cabinet 10. The door 100 may be coupled to the cabinet 10 by a hinge device 30.

The cabinet 10 accommodates a sump unit 40 provided below the washing tub 21 to collect water to be used for washing, a pair of baskets 50 arranged to be withdrawable from the inside of the cabinet 10 and allowing dishware to be placed thereon, and a plurality of spray nozzles 71, 72 and 73 for spraying water delivered from the sump unit 40 toward the dishware contained in the pair of baskets 50.

Relatively large dishware may be stored in the pair of baskets 50. The type and size of the dishware stored in the pair of baskets 50 are not limited. The dishware stored in the pair of baskets 50 may include large dishware or small dishware.

The pair of baskets 50 may include a first basket 51 and a second basket 52. The first basket 51 may be disposed on the upper side of the washing tub 21. The first basket 51 may be located above the second basket 52. The second basket 52 may be disposed on the lower side of the washing tub 21.

The washing tub 21 may include a first guide rack 61 provided to support the first basket 51. The washing tub 21 may include a second guide rack 62 provided to support the second basket 52.

The first guide rack 61 and the second guide rack 62 may be installed on the inner side of the washing tub 21 such that the first basket 51 and the second basket 52 are slidable toward the front of the washing tub 21.

The first guide rack 61 and the second guide rack 62 may be installed on the left side and the right side of the washing tub 21, respectively. The first basket 51 and the second basket 52 may be slidable along the first guide rack 61 and the second guide rack 62 in the front-rear direction of the washing tub 21.

The sump unit 40 may be disposed at the center of the bottom of the washing tub 21 to collect wash water to be used for washing. The sump unit 40 may be provided with a washing pump 41 that pumps the stored water to a spray unit 70. The wash water pumped by the washing pump 41 may be supplied to a first spray nozzle 71, a second spray nozzle 72, and a third spray nozzle 72, which will be described below, through a supply pipe 80.

The dishwasher 1 may further include a heater 42 disposed below the washing tub 21 to heat the wash water, and a drainage pump 43 disposed below the washing tub 21 to drain the wash water.

The dishwasher 1 may include the spray unit 70 provided to spray wash water. The spray unit 70 may include the first spray nozzle 71 disposed above the first basket 51, the second spray nozzle 72 disposed above the second basket 52, that is, between the first basket 51 and the second basket 52, and the third spray nozzle 73 disposed below the second basket 52.

The first spray nozzle 71 is provided to be rotatable. The first spray nozzle 71 may spray wash water toward dishware stored in the first basket 51. The second spray nozzle 72 is provided to be rotatable. The second spray nozzle 72 is provided to spray wash water toward dishware stored in the first basket 51 and the second basket 52. The third spray nozzle 73 is provided to be rotatable. The third spray nozzle 73 is provided to spray the wash water toward dishware stored in the second basket 52.

The door 100 may be detachable from, or attachable to and fixed to the cabinet 10 through a locking device 300. The locking device 300 may include a locker 310 provided on one of the door 100 and the cabinet 10 and a latch 320 provided on the other one of the door 100 and the cabinet 10. The latch 320 is separably coupled to the locker 310. The locker 310 and the latch 320 installed on the door 100 and the cabinet 10 may be provided at positions corresponding to each other. One of the latch 320 and the locker 310 may be installed on an upper side of the front plate 10*a* of the cabinet 10. The other one of the latch 320 and the locker 310 may be installed on the upper side of the door 100. In the embodiment of the disclosure, the locker is disposed on the door and the latch is disposed on the cabinet so that the door is fixed to the cabinet, but the aspect of the disclosure is not limited thereto.

The door 100 may include first and second door members 110 and 120 forming the external appearance thereof and a handle member 200 disposed between the first door member 110 and the second door member 120.

The first door member 110 may form an upper portion of the door 100 and the second door member 120 may form a lower portion of the door 100. The first door member 110 and the second door member 120 may form the front appearance of the door 100.

The handle member 200 may be provided below the first door member 110. The handle member 200 may be disposed between the first door member 110 and the second door member 120. The handle member 200 may form the front appearance of the door 100 between the first door member 110 and the second door member 120.

The door 100 may further include a rear cover 130 forming a rear surface thereof. The rear cover 130 may be provided to cover the rear sides of the first door member 110 and the second door member 120. The rear cover 130 may be provided to cover the rear side of the handle member 200. The rear cover 130 may be formed in a size and shape corresponding to those of the door 100. The rear cover 130 may be formed in a plate shape. The rear cover 130 may include a rear cover body 131 having a quadrangular shape and a rear cover frame 132 extending outside of the rear cover body 131.

The rear cover frame 132 is provided with a first fixing portion 141 formed to be coupled to the first door member 110 and the second door member 120 of the door 100. The first door member 110 and the second door member 120 may each be provided with a second fixing portion 142 corresponding to the first fixing portion 141. The rear cover 130 may be fixed to the first door member 110 and the second door member 120 through the first fixing portion 141 and the second fixing portion 142 (see FIG. 4).

The rear cover 130 may be formed with a locking device installation hole 311 that is formed to pass through the rear cover 130 so that the locker 310 of the locking device 300 is installed thereon. The locking device installation hole 311 may be formed in a size and shape corresponding to those of the locker 310 so that the locker 310 protrudes through the locking device installation hole 311. The locking device installation hole 311 may be formed in the rear cover frame 132. The rear cover 130 of the door 100 may form the front side of the washing tub 21. The rear cover 130 may form the front side of the washing chamber 20. The rear cover 130 may be provided in at least a portion thereof with an installation hole 133 for installing a detergent supply device (not shown).

Water sprayed in the washing chamber 20 of the dishwasher 1 and used for washing may flow into the door 100 through the locking device installation hole 311 of the rear cover 130.

The door 100 may include a water discharge channel 400 such that the water flowing into the door 100 through the locking device installation hole 311 is discharged. The water discharge channel 400 may be provided such that water is discharged through the first door member 110 (hereinafter, referred to as a "door member") and the handle member 200. The water discharge channel 400 may include a water inlet 401 formed in at least a portion of the door 100. The water inlet 401 may include the locking device installation hole 311 formed in the rear cover 130. In the embodiment of the disclosure, the water inlet is illustrated as the locking device installation hole of the rear cover, but the aspect of the disclosure is not limited thereto. For example, the water inlet may include part of a gap between the door member and the rear cover.

Figure 4:
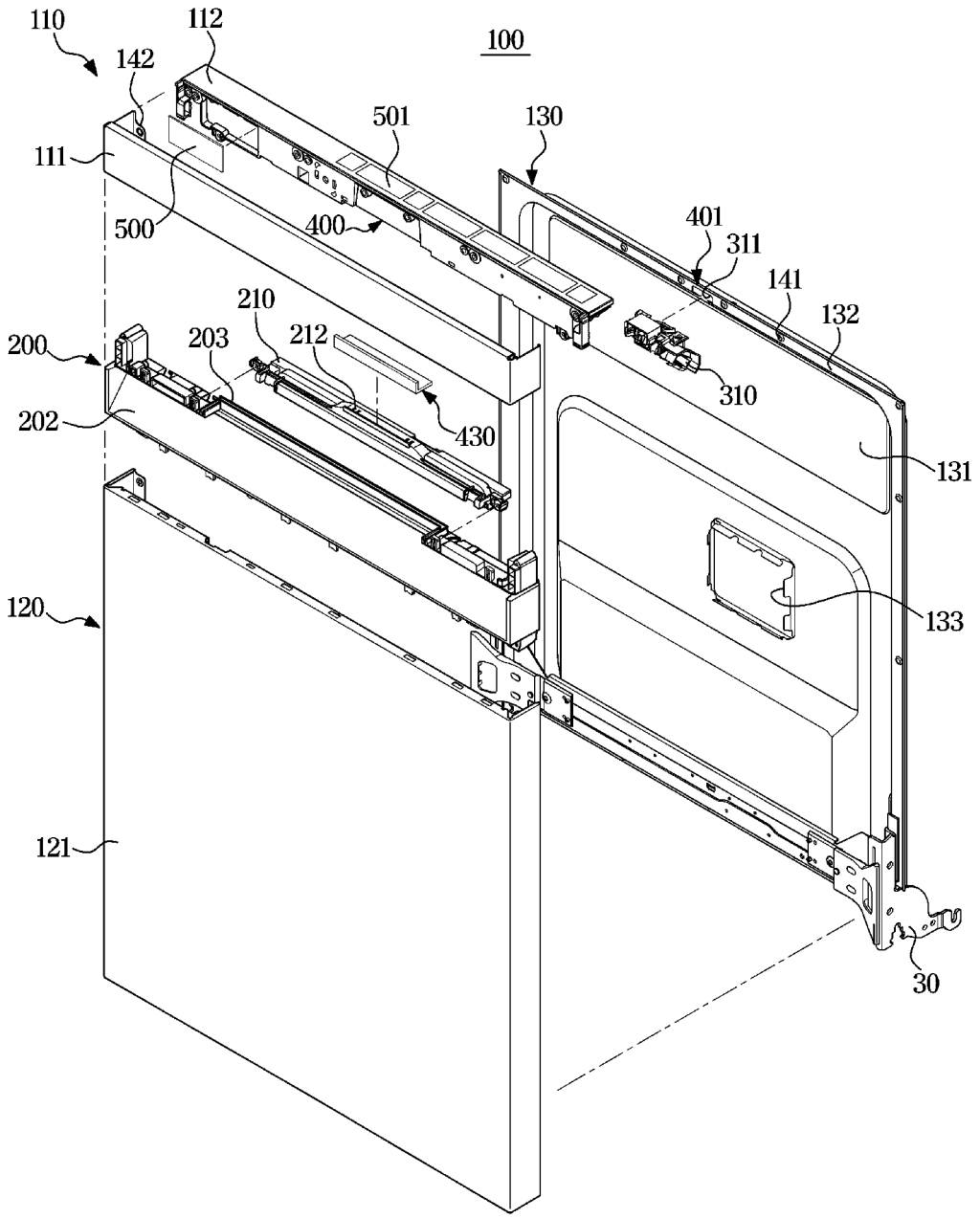
FIG. 4 is an exploded perspective view illustrating the door of the dishwasher according to the embodiment of the disclosure.
Figure 5:
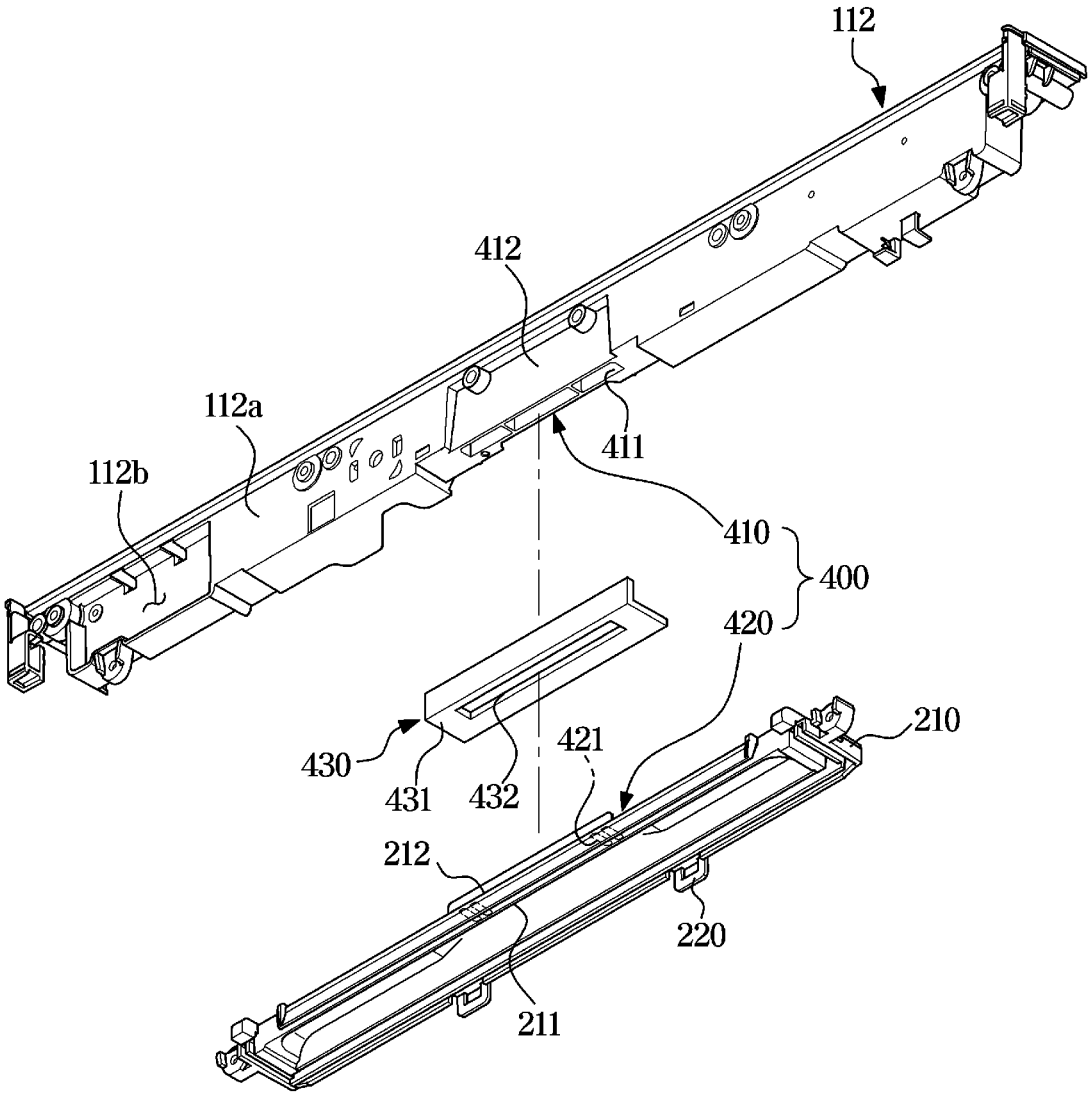
FIG. 5 is an exploded perspective view illustrating a door member and a handle member of the door according to the embodiment of the disclosure.
Figure 6:
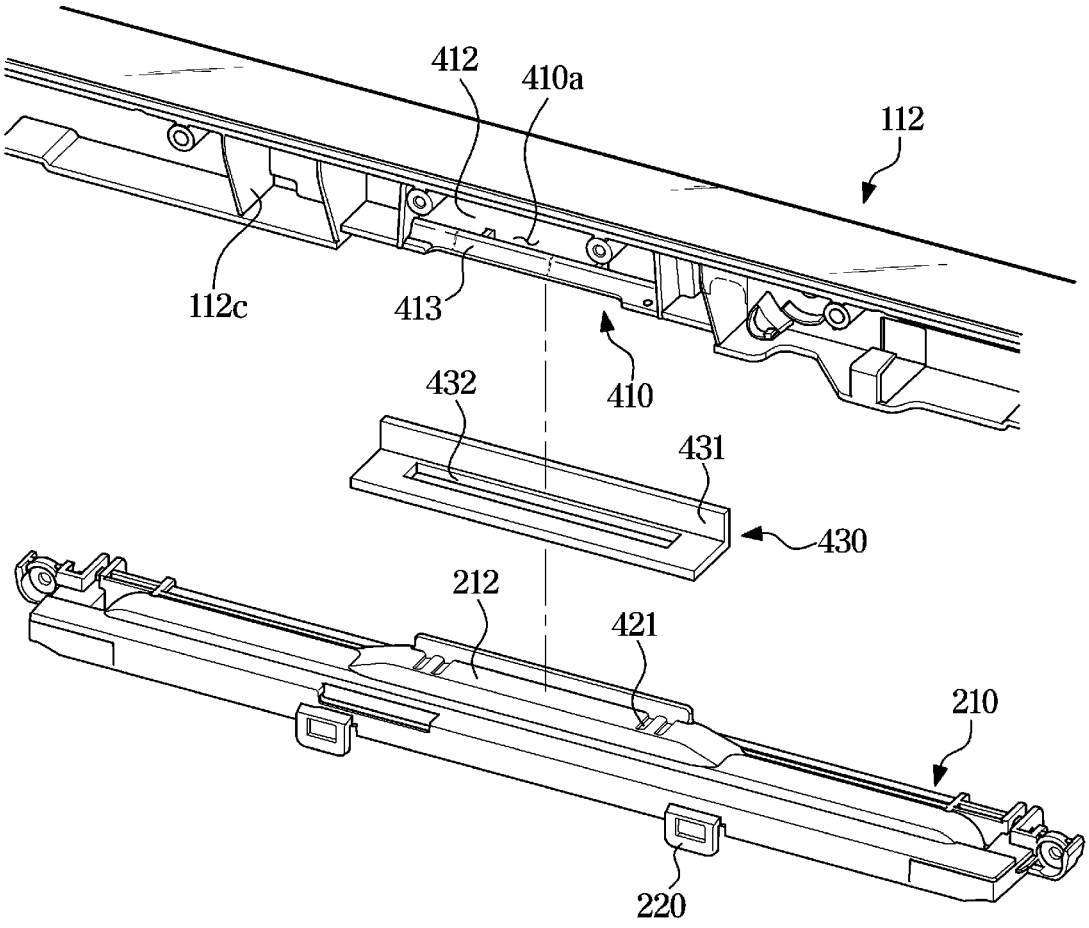
FIG. 6 is a view illustrating a water discharge channel formed in the door member and the handle member according to the embodiment of the disclosure.
Figure 7:
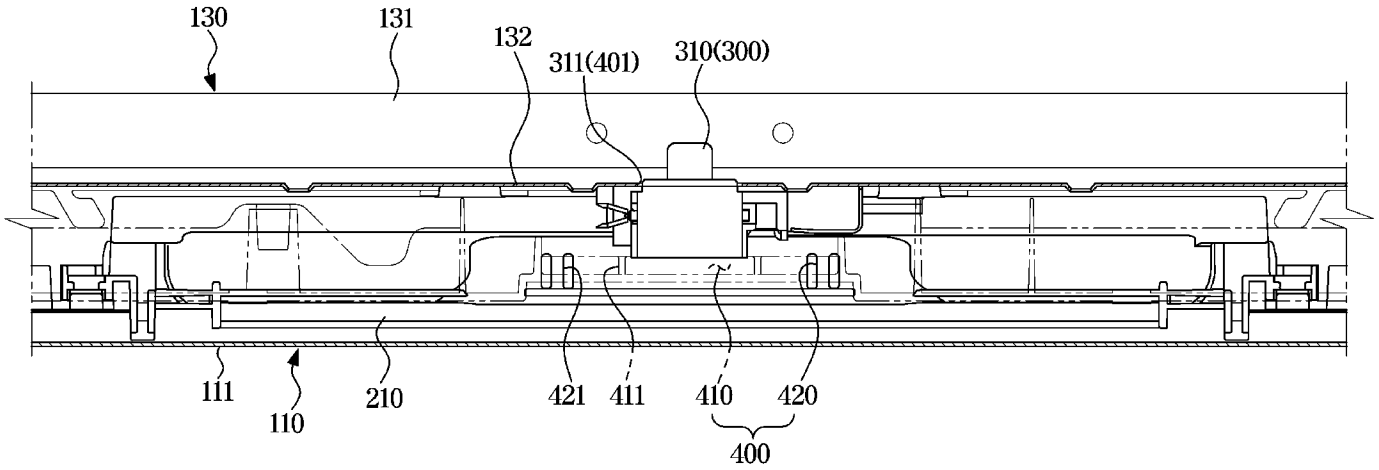
FIG. 7 is a view showing the water discharge channel according to the embodiment of the disclosure.
Figure 8:
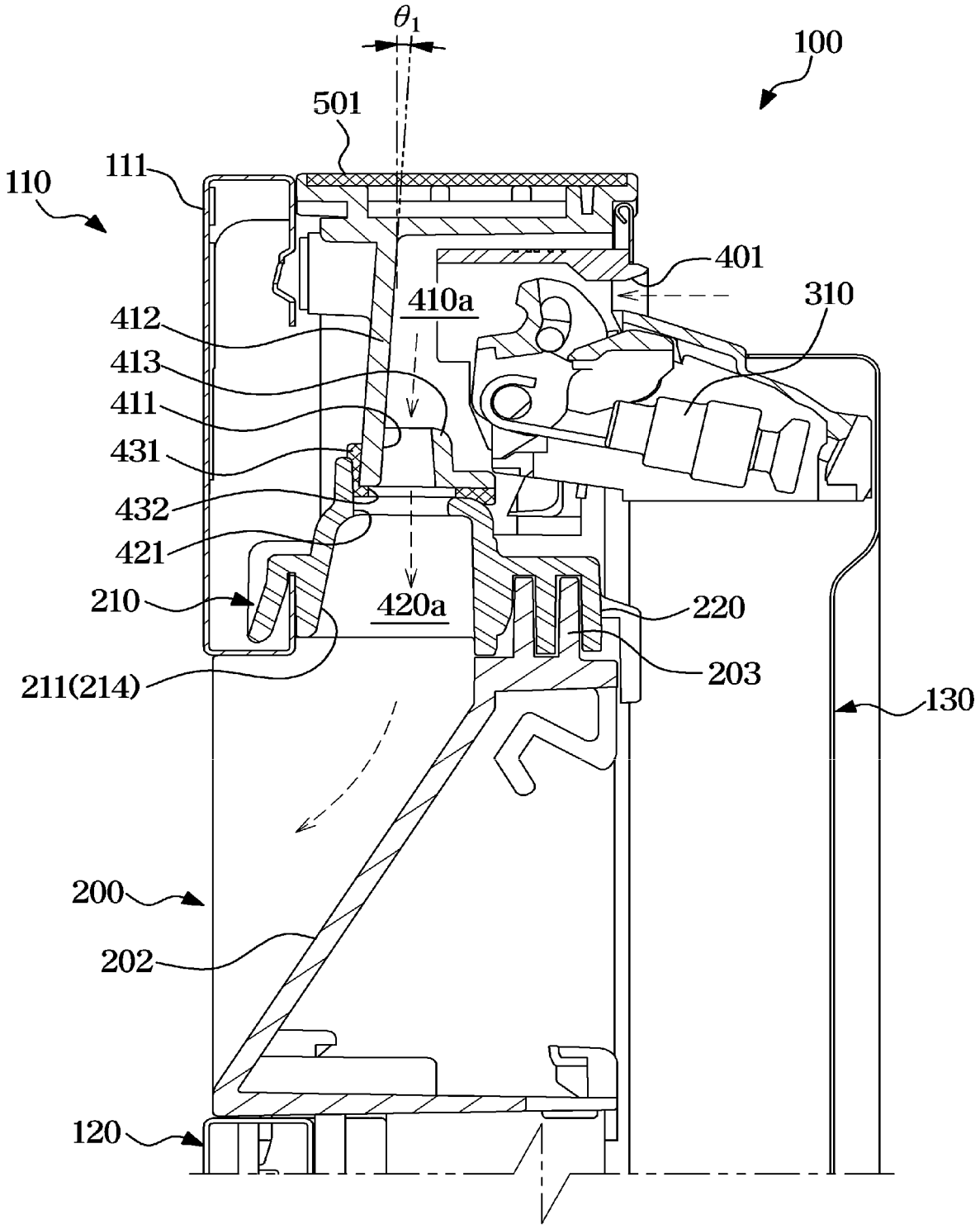
FIG. 8 is a view showing the water discharge channel according to the embodiment of the disclosure

FIG. 4 is an exploded perspective view illustrating the door of the dishwasher according to the embodiment of the disclosure, FIG. 5 is an exploded perspective view illustrating the door member and the handle member of the door according to the embodiment of the disclosure, FIG. 6 is a view illustrating the water discharge channel formed in the door member and the handle member according to the embodiment of the disclosure, FIG. 7 is a view showing the water discharge channel according to the embodiment of the disclosure, and FIG. 8 is a view showing the water discharge channel according to the embodiment of the disclosure.

Referring to FIGS. 4 to 8, the door 100 may be installed on the cabinet 10 to open and close the washing tub 21.

The water discharge channel 400 of the door 100 includes the water inlet 401 formed in at least a portion of the door 100, a first outlet 410 formed in the door member 110, and a second outlet 420 formed in the handle member 200.

Water flowing into the door 100 through the water inlet 401 moves through the first outlet 410 and the second outlet 420 sequentially, and then is discharged to the outside of the door 100.

Specifically, the door 100 may include the first door member 110 disposed on the upper side and the second door member 120 disposed on the lower side. The handle member 200 is provided between the first door member 110 and the second door member 120. Water moving through the first door member 110 may be discharged to the outside of the door 100 through the handle member 200.

The first door member 110 may include a first door panel 111 and a control frame 112. The first door member 110 may form the upper portion of the door 100. The first door panel 111 may form a front upper side of the door 100. The first door panel 111 may include a rectangular plate. The first door panel 111 may be formed of various materials, for example, may include a metal material. The control frame 112 is provided to be coupled to the first door panel 111. The control frame 112 may be coupled to the rear side of the first door panel 111 to form the rear upper side of the door 10.

The control frame 112 may be provided for various electrical components 500 to be installed thereon. The control frame 112 is provided so that various electrical components 500 including a printed circuit board (PCB), for example, a main PCB and a sub PCB, are installed thereon.

On the control frame 112, a control unit 501 for controlling and displaying the dishwasher 1 may be provided. The control unit 501 may be provided on the upper end of the control frame 112. The control unit 501 may be formed on the upper end of the door 100. A PCB (not shown) may be installed on the control unit 501. In the embodiment of the disclosure, for example, the control unit is illustrated as being disposed on the upper surface of the door, but the aspect of the disclosure is not limited thereto. For example, the control unit may be disposed on the front side of the door.

The handle member 200 may be provided below the control frame 112. The handle member 200 may include an inclined panel 202 and a handle frame 210 coupled to the inclined panel 202 and forming a handle 211(214).

On the inclined panel 202 of the handle member 200, a display 201 may be disposed. The display 201 configured to visually display an operating state of the dishwasher 1 may be provided on at least a portion of the inclined panel 202 of the handle member 200. The display 201 is provided to display various pieces of information, such as an operation state and an operation time.

The inclined panel 202 of the handle member 200 may be formed with an upper end thereof disposed at the rear of the door 100 and a lower end thereof disposed at the front of the door 100. The inclined panel 202 may be disposed to have an inclined surface facing the front upper side of the door 100. The upper end of the inclined panel 202 may be connected to the first door member 110, and the lower end of the inclined panel 202 may be connected to the second door member 120.

The handle frame 210 may be coupled to the upper side of the inclined panel 202. The inclined panel 202 may be provided at an upper end thereof with a handle frame coupling portion 203 to which the handle frame 210 is coupled. The handle frame coupling portion 203 may include a plurality of protrusions protruding from the upper end of the inclined panel 202. The handle frame 210 may be provided with a handle frame support 220 including a plurality of grooves to correspond to the handle frame coupling portion 203. The handle frame support 220 is formed to correspond to the handle frame coupling portion 203 such that the handle frame 210 is coupled between the inclined panel 202 and the first door member 110. The handle frame 210 is firmly supported by the handle frame support 220 such that the handle frame 210 does not move when the user opens the door 10 by pulling the handle 211(214) of the handle frame 210.

The handle frame 210 may be disposed between the inclined panel 202 and the first door member 110. The handle frame 210 may include the handle 211(214) having a handle recess that is provided to be gripped by the user.

The handle frame 210 may include the handle groove 212. The handle frame 210 may include the handle groove 212 formed to be recessed toward the first door member 110. The handle groove 212 may be provided such that a user may slip the user's hand into the handle groove 212 and open the door 100.

The handle member 200 may be coupled to the upper side of the second door member 120. The second door member 120 may include a second door panel 120. The second door panel 120 may form the front lower portion of the door 100. The second door panel 120 may include various materials. The second door panel 120 may be formed of the same material as that of the first door panel 111. The second door panel 120 may be formed of a different material from that of the first door panel 111. The second door panel 120 may be provided to have the rear side thereof covered by the rear cover 130.

The control unit 501 for controlling and displaying the dishwasher 1 may be provided on the control frame 112 of the first door member 110. The control frame 112 may be provided for various electrical components 500 to be installed thereon. The control frame 112 is provided for various electrical components 500 including a PCB, for example, a main PCB and a sub PCB, to be installed thereon. On the control frame 112, the control unit 501 formed on the upper end of the door 100 may be installed. On the control unit 501, PCBs (not shown) may be installed.

The control frame 112 may be coupled to the rear side of the first door panel 111. The control frame 112 may form an upper portion of the door 100. The control frame 112 may include a control frame body **112*a* having a size and shape corresponding to those of the first door panel 111. The control frame body 112*a* may be provided with an electrical component installation portion 112*b* that allows the electrical component 500** to be mounted thereon.

The water discharge channel 400 of the door 100 includes the water inlet 401 formed in at least a portion of the door 100, the first outlet 410 formed in the first door member 110, and the second outlet 420 formed in the handle member 200.

The water discharge channel 400 may be provided in the control frame 112 of the first door member 110 and the handle frame 210 of the handle member 200. A first discharge channel **400*a* of the water discharge channel 400 may be provided in the first door member (hereinafter, referred to as a door member 110). The first discharge channel 400*a* may be provided in the control frame 112 of the door member 110. The first discharge channel 400*a* may include the first outlet 410**.

The first discharge channel **400*a* may be provided in the control frame body 112*a*. The first outlet 410 may be provided in the control frame body 112***a*. The first discharge channel 400*a* may be formed at a position corresponding to that of the water inlet 401.

The first outlet 410 includes a first discharge hole 411 formed at a lower side of the control frame 112 and a first discharge surface 412 formed to guide water toward the first discharge hole 411.

The first discharge surface 412 may be formed on the control frame body 112*a*. The first discharge surface 412 may be formed at a first angle 81 on the control frame body 112*a*. The first discharge surface 412 may be formed to be inclined toward the first discharge hole 411 so that water flowing through the water inlet 401 is discharged through the first discharge hole 411. The first discharge hole 411 may be provided in at least one unit thereof. The first discharge hole 411 may further include a guide rib 413 for guiding water moving along the first discharge surface to the first discharge hole 411 without moving along another path. The guide rib 413 may be disposed to face the first discharge surface 412.

The control frame 112 may be provided with at least one partition wall 112*c* to block movement of water flowing through the water inlet 401. The control frame 112 may be provided with the at least one partition wall 112*c* to block movement of water in the first outlet 410. The at least one partition wall may be provided on the control frame body 112*a*.

A second discharge channel 400*b* of the water discharge channel 400 may be provided in the handle member 200. The second discharge channel 400*b* may be provided in the handle frame 210 of the handle member 200. The second discharge channel 400*b* may include the second outlet 420.

The second discharge channel 400*b* may be formed at a position corresponding to that of the first discharge channel 400*a*. The second outlet 420 of the second discharge channel 400*b* may be formed at a position corresponding to that of the first outlet 410 of the first discharge channel 400*a*. The second outlet 420 is provided to be connected to the first outlet 410.

The second outlet 420 may include a second discharge hole 421 formed in the upper side of the handle frame 210. The second discharge hole 421 may be provided in at least one unit thereof. The second discharge hole 421 may be formed at a position corresponding to that of the first discharge hole 411. The second discharge hole 421 may be formed in the handle groove 212 of the handle frame 210. The second discharge hole 421 may be formed in the upper surface of the handle groove 212. In the embodiment of the disclosure, two units of the second discharge holes are formed on each side of the handle groove 212, but the aspect of the disclosure is not limited thereto. For example, the number and shape of the second discharge holes may be variously changed.

The door 100 may include a water leakage preventing member 430 provided to prevent water of the water discharge channel 400 from leaking between the door member 110 and the handle member 200. The water leakage preventing member 430 may be provided to prevent leakage between the door member 110 and the handle member 200. The water leakage preventing member 430 may be disposed between the first discharge channel 400*a* and the second discharge channel 400*b*. The water leakage preventing member 430 may be provided between the first outlet 410 and the second outlet 420. The water leakage preventing member 430 may include a water leakage preventing body 431 and an outlet 432 that is provided as an opening formed in at least a portion of the water leakage preventing body 431. The water leakage preventing body 431 may be provided to prevent water from moving into a space between the door member 110 and the handle member 200. The outlet 432 formed in the water leakage preventing body 431 is disposed between the first discharge hole 411 and the second discharge hole 421 so that water moving to the first discharge hole 411 is discharged to the second discharge hole 421 without leaking to another place.

Water remaining on the dishware or on the inner surface of the door 100 after the washing operation of the dishwasher 1 may flow into the door 100 through the water inlet 401 formed in the rear cover 130 of the door 100 when the door 100 is opened.

The water flowing into the door 100 as the above may be discharged to the outside of the door 100 through the water discharge channel 400 of the door 100.

The water flowing into the door 100 through the water inlet 401 is moved to a side of the first discharge hole 411 along the inclination of the first discharge surface 412 of the first discharge channel 400*a* formed in the door member 110.

The water moved to the first discharge hole 411 may be discharged to the outside of the door 100 through the second discharge hole 421 connected to the first discharge hole 411. Since the second discharge hole 421 is formed in the handle groove 212 of the handle member 200, water discharged through the second discharge hole 421 is discharged to the inclined panel 202 of the handle member 200.

In this case, the water leakage preventing member 430 provided between the first discharge hole 411 and the second discharge hole 421 of the door member 110 and the handle member 200 allows the water in the water discharge channel 400 to be discharged to the outside of the door 100 through the second discharge hole 421 without moving to other sides of the door 100.

As is apparent from the above, the improved door structure can discharge water flowing to the inside of the door to the outside of the door.

In addition, the penetration of water to the electrical components, such as a printed circuit board (PCB), is prevented, thereby preventing defects from occurring while improving the product reliability.

In addition, the water flowing into the door is allowed to be directly drained, thereby minimizing a water flow path and preventing water from being moved to an undesired area.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

What is claimed is:

1. A dishwasher comprising:

a cabinet having a washing tub; and a door installed at one side of the cabinet to open or close the washing tub, wherein the door includes:

a door member in which an electrical component is installed;

a handle member installed on the door member to form a handle; and a water discharge channel formed in the door to allow water to be discharged to outside of the door through the door member and the handle member, wherein the water discharge channel includes:

a water inlet formed on at least one portion of the door;

a first outlet formed on the door member; and a second outlet formed on the handle member and connected to the first outlet, wherein the door member includes a control frame on which the electrical component and a printed circuit board (PCB) are installed and to which the handle member is coupled, and the first outlet is formed on the control frame.

2. The dishwasher of claim 1, wherein the door includes a rear cover configured to form a rear surface of the door, and the water inlet is disposed on the rear cover.

3. The dishwasher of claim 2, wherein the first outlet is provided at a position corresponding to a position of the water inlet.

4. The dishwasher of claim 1, wherein the first outlet includes a first discharge hole formed at a lower side of the control frame and a first discharge surface inclined to guide the water toward the first discharge hole.

5. The dishwasher of claim 4, wherein the first outlet further includes a guide rib allowing water to be guided through the first discharge hole.

6. The dishwasher of claim 3, wherein the control frame further includes at least one partition wall configured to limit movement of water of the first outlet.

7. The dishwasher of claim 4, wherein the handle member includes:

an inclined panel inclined in a direction toward an inside of the cabinet; and a handle cover coupled to the inclined panel and provided to form a handle recess between the door member and the handle cover, and wherein the second outlet is disposed on the handle cover.

8. The dishwasher of claim 7, wherein the second outlet includes at least one second discharge hole.

9. The dishwasher of claim 8, wherein the second discharge hole is disposed at a position corresponding to a position of the first discharge hole.

10. The dishwasher of claim 9, further comprising a water leakage preventing member provided to prevent water from leaking between the door member and the handle member.

11. The dishwasher of claim 10, wherein the water leakage member includes a discharge port corresponding to the first discharge hole and the second discharge hole.

12. The dishwasher of claim 8, wherein the second discharge hole is disposed on the handle recess.

13. A dishwasher comprising:

a cabinet having a washing tub; and a door rotatably installed at one side of the cabinet to open or close the washing tub, the door including:

a door member on which an electrical component and a printed circuit board (PCB) are installed;

a handle member coupled to the door member and having a handle recess; and a water discharge channel formed in the door to allow water to be discharged through the door member and the handle recess of the handle member, wherein the water discharge channel includes:

a water inlet formed on at least one portion of the door;

a first outlet formed on the door member; and a second outlet formed on the handle member and connected to the first outlet, wherein the door member includes a control frame on which the electrical component and the printed circuit board (PCB) are installed and to which the handle member is coupled, and the first outlet is formed on the control frame.

14. The dishwasher of claim 13, wherein the first outlet is provided at a position corresponding to a position of the water inlet.

15. The dishwasher of claim 13, wherein the first outlet includes a first discharge hole formed at a lower side of the door member and a first discharge surface inclined to guide water toward the first discharge hole.

16. The dishwasher of claim 15, wherein the second outlet includes at least one second discharge hole, and the second discharge hole is disposed at a position corresponding to a position of the first discharge hole.

17. The dishwasher of claim 16, further comprising a water leakage preventing member that includes a discharge port corresponding to the first discharge hole and the second discharge hole to prevent water from leaking between the first discharge hole and the second discharge hole.

* * * * *